US009029703B2

(12) United States Patent
Huang et al.

(10) Patent No.: US 9,029,703 B2
(45) Date of Patent: May 12, 2015

(54) ELECTRONICALLY-CONTROLLABLE WOVEN ARTICLE WITH RECEPTACLE STRUCTURE

(75) Inventors: Hong-Hsu Huang, Taipei (TW); Jung-Hsiang Peng, Taipei (TW)

(73) Assignee: King's Metal Fiber Technologies Co., Ltd., Taichung (TW)

( * ) Notice: Subject to any disclaimer, the term of this patent is extended or adjusted under 35 U.S.C. 154(b) by 397 days.

(21) Appl. No.: 13/464,153

(22) Filed: May 4, 2012

(65) Prior Publication Data

US 2013/0292172 A1 Nov. 7, 2013

(51) Int. Cl.
*H01R 3/00* (2006.01)
*A41D 1/00* (2006.01)
*H01R 12/59* (2011.01)

(52) U.S. Cl.
CPC ..... *A41D 1/005* (2013.01); *H01R 12/59* (2013.01); *D10B 2401/18* (2013.01)

(58) Field of Classification Search
USPC ..... 174/117 M, 93, 74 R; 439/37
See application file for complete search history.

(56) References Cited

U.S. PATENT DOCUMENTS

2006/0128169 A1* 6/2006 Marmaropoulos et al. ..... 439/37
2006/0166520 A1* 7/2006 Marmaropoulos et al. ..... 439/37
2009/0272570 A1* 11/2009 Chen ..... 174/350

* cited by examiner

*Primary Examiner* — Chau N Nguyen
(74) *Attorney, Agent, or Firm* — Rosenberg, Klein & Lee

(57) ABSTRACT

The present invention relates to an electronically-controllable woven article with receptacle structure for electrically connecting at least one electronic unit. The electronically-controllable woven article includes a first metal yarn strand; a second metal yarn strand, which is arranged at one side of the first metal yarn strand in a side-by-side manner; at least one receptacle structure, which forms a receiving space corresponding to the electronic unit, the first metal yarn strand and the second metal yarn strand extending into the receiving space, the first metal yarn strand having a section corresponding to the receiving space, the second metal yarn strand having a section corresponding to the receiving space, both sections coupled to the receptacle structure; and a power supply unit, which is electrically connected to the first metal yarn strand and the second metal yarn strand.

22 Claims, 10 Drawing Sheets

ELECTRONICALLY-CONTROLLABLE WOVEN ARTICLE WITH RECEPTACLE STRUCTURE

FIELD OF THE INVENTION

The present invention relates to an electronically-controllable woven article with receptacle structure, and in particular to an electronically-controllable woven article that combines conductive wires in the woven structure and comprises a receptacle structure so that electronic units can be attached to the surface of the woven article and the operation of the electronic units can be controlled.

BACKGROUND OF THE INVENTION

An ordinary woven article, such as a hat and a garment, is formed by sewing a plurality of woven pieces together. A sewing gap is thus formed between two adjacent pieces. For the purpose of protecting the sewing threads between the pieces from being stretched by an external force and thus broken or simply for the sake of aesthetics, a strip is often provided to cover the sewing gap and is fixed by stitching to ensure tight jointing, proper coverage of the gap, and/or decoration. The strip is formed by weaving interlaced yarns extending in warp and weft directions in order to provide the strip with strong and stretch-resistant properties.

To improve safety of the wearers, manufacturers combine fibers with light reflectivity with regular fibers to form composite yarns and then weave the composite yarns to make a strip, or simply weave light reflective yarns with regular yarns to form a strip. In these ways, the strips so made provide a function of alarming through light reflection. However, such strips do not actively emit light and must be subjected to light irradiation before the function of alarming can be realized through reflection of the light. This is an undesired constraint. Further, such a strip may not be effective in reflecting light for alarming in an environment where lighting is poor or no lighting is available, such as in a dark lane in the nighttime, a water source site or ecological conservation area, or in an environment where surrounding light is excessively intense, such as daytime.

Thus, the present invention aims to provide an electronically-controllable woven article that comprises a receptacle structure, is combinable with a woven object for use, shows flexibility, and provides functionalities of lighting alarm, heat generation and warm keeping, sound emitting for reminder, or vibration for massage, so as to be easily combined with various woven objects, such as hat, garment, pants, pouch, and bag for receiving and holding various electronic units, such as electronic devices and electronic components to be controlled by a user, thereby improving utility, convenience, and safety.

SUMMARY OF THE INVENTION

An object of the present invention is to provide an electronically-controllable woven article that comprises a receptacle structure, is combinable with a woven object for use, shows flexibility, and provides functionalities of lighting alarm, heat generation and warm keeping, sound emitting for reminder, or vibration for massage, so as to be easily combined with various woven objects, such as hat, garment, pants, pouch, and bag for receiving and holding various electronic units, such as electronic devices and electronic components to be controlled by a user, thereby improving utility, convenience, and safety.

To achieve the above object, the present invention provides an electronically-controllable woven article with receptacle structure for electrically connecting at least one electronic unit. The electronically-controllable woven article comprises a first metal yarn strand; a second metal yarn strand, which is arranged at one side of the first metal yarn strand in a side-by-side manner; at least one receptacle structure, which forms a receiving space corresponding to the electronic unit, the first metal yarn strand and the second metal yarn strand extending into the receiving space, the first metal yarn strand having a section corresponding to the receiving space, the second metal yarn strand having a section corresponding to the receiving space, both sections coupled to the receptacle structure; and a power supply unit, which is electrically connected to the first metal yarn strand and the second metal yarn strand.

As such, the receptacle structure can be used to receive and hold a power supply unit, such as an electrical cell or a controller and can be coupled to a woven article for use and has flexibility so as to be easily couple to various woven articles, such as a hat, a garment, pants, a pouch, and a bag for receiving and holding various electronic units, such as electronic devices and electronic components to provide functions of lighting alarm, heating and warm keeping, sounding and reminding, or vibrating and massaging so as to improve utility, convenience, and safety of use.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 5:
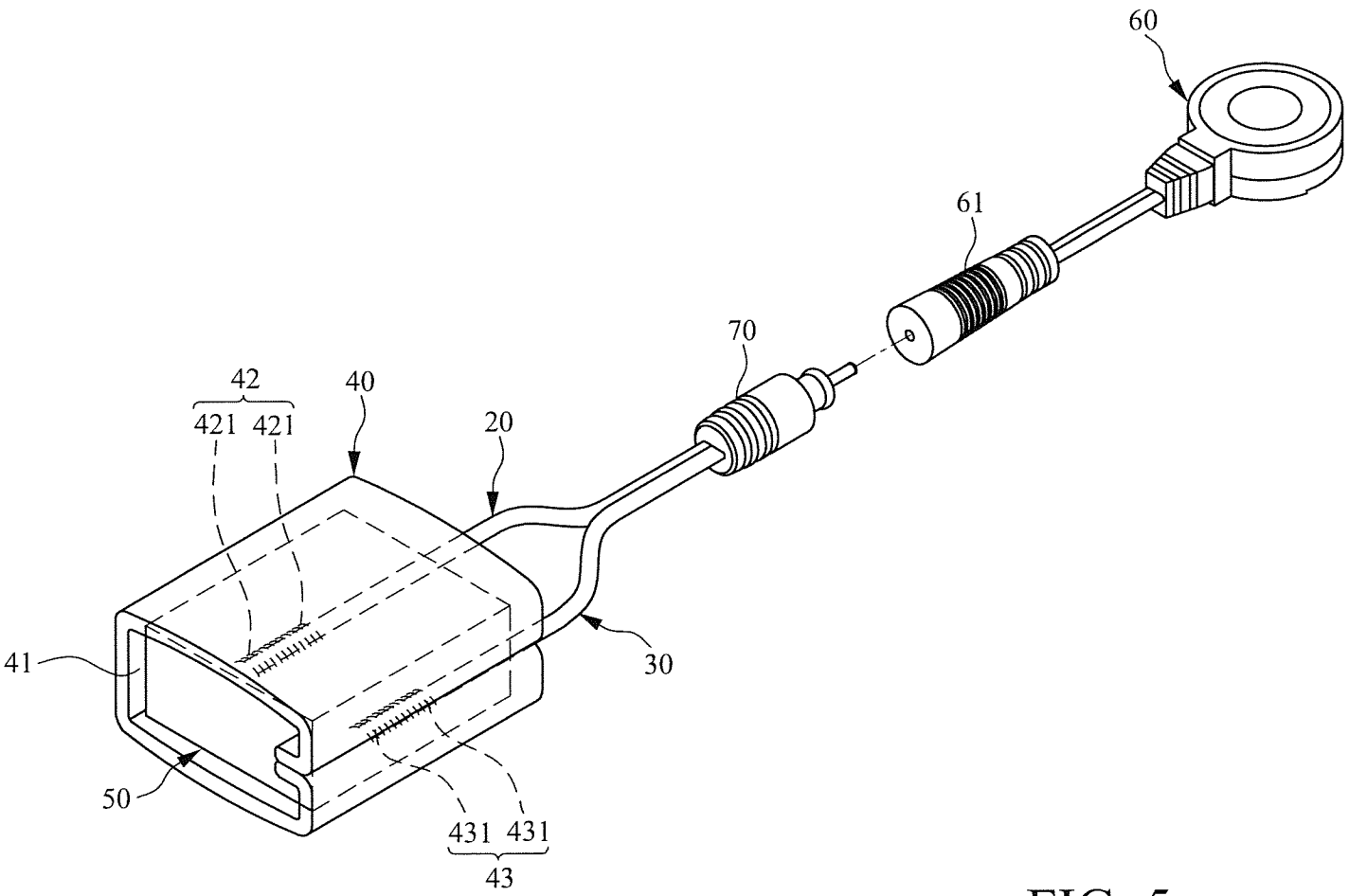
FIG. 5 is a perspective view showing the electronically-controllable woven article of FIG. 1 combined with a connector for selective connection with a counterpart connector.
Figure 6:
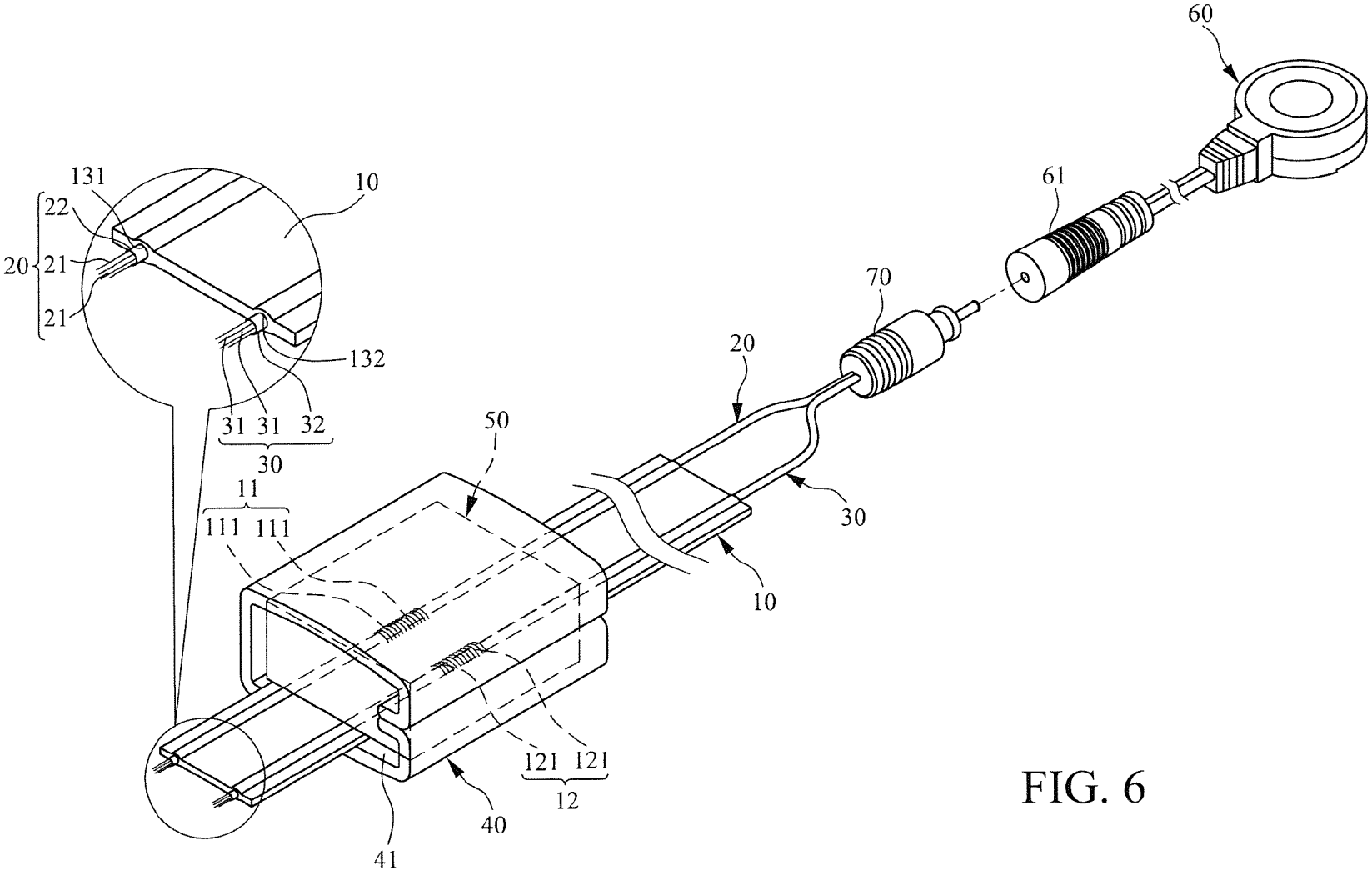
FIG. 6 is a perspective view showing a power supply unit of FIG. 3 being embodied as a controller and the power supply unit being arranged to couple to a connector for selective connection with a counterpart connector.
Figure 7:
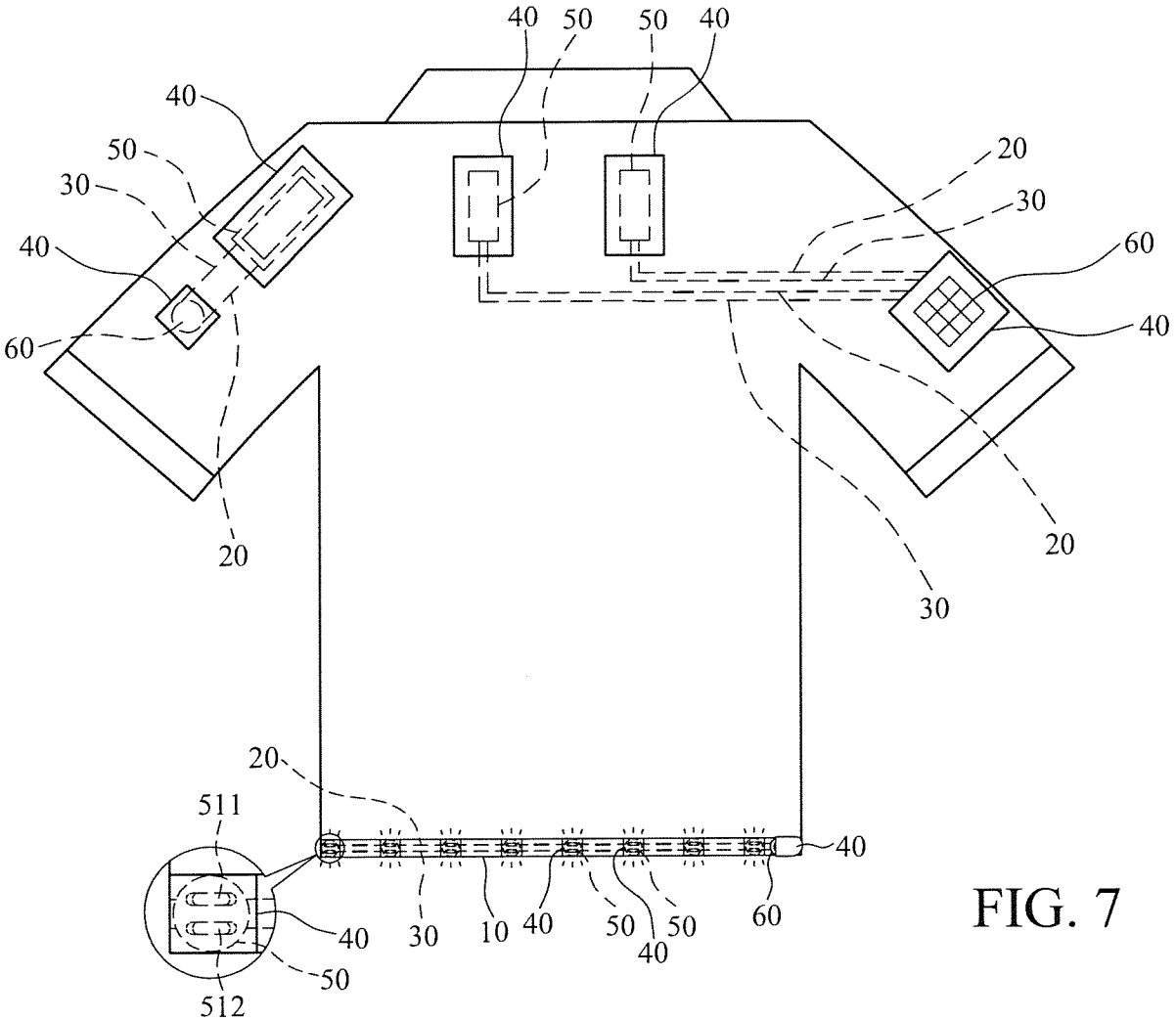
FIG. 7 is a schematic view showing the electronically-controllable woven article according to the present invention being coupled to a garment.
Figure 8:
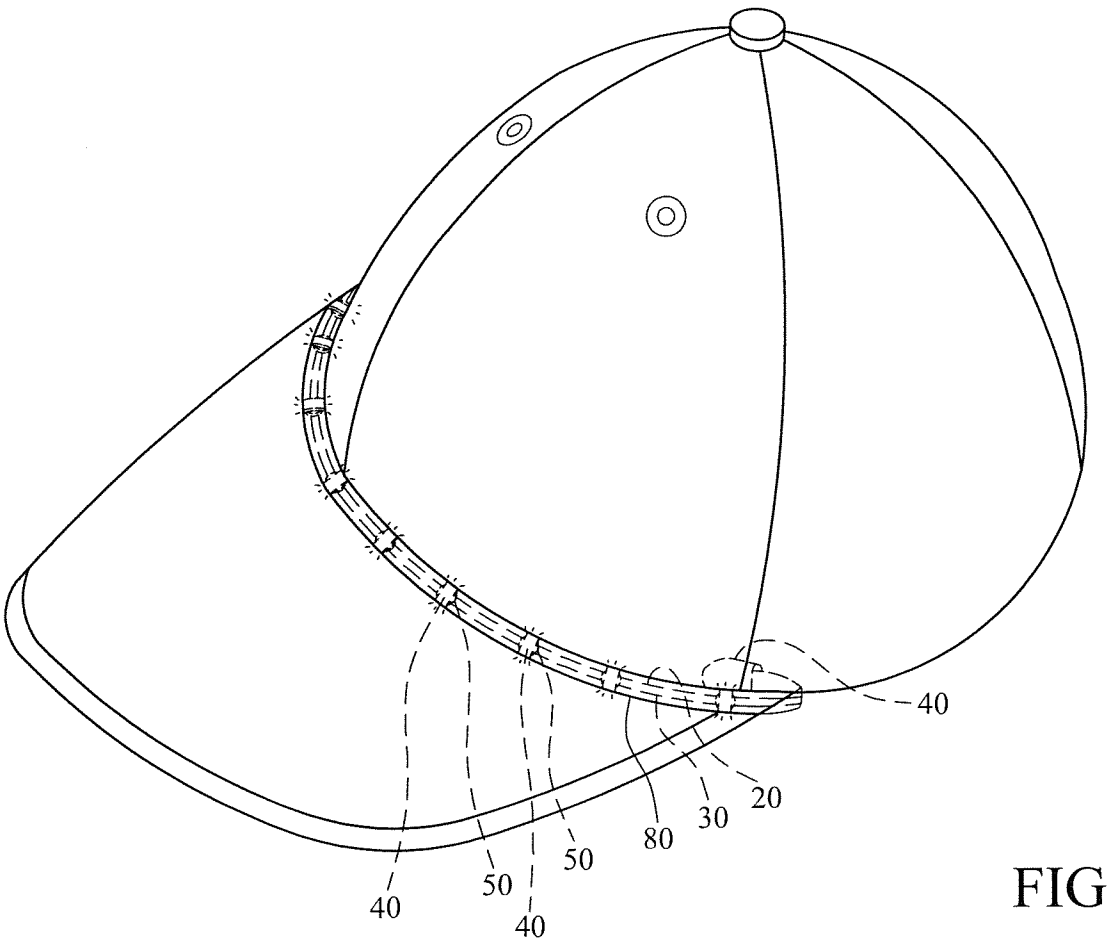
FIG. 8 is a schematic view showing the electronically-controllable woven article according to the present invention being coupled to a hat.

With reference to the drawings and in particular to FIGS. 1-10, an electronically-controllable woven article with receptacle structure is shown for being electrically connectable to at least one electronic unit 50. The electronically-controllable woven article comprise a first metal yarn strand 20, a second metal yarn strand 30, at least one receptacle structure 40, and a power supply unit 60. The second metal yarn strand 30 is arranged at one side in parallel with the first metal yarn strand 20. The receptacle structure 40 forms a receiving space 41 corresponding to the electronic unit. The first metal yarn strand 20 and the second metal yarn strand 30 extends into the receiving space 41. An internal section of the first metal yarn strand 20 corresponding to the receiving space 41 and an internal section of the second metal yarn strand 30 corresponding to the receiving space 41 are both mounted to the receptacle structure 40. The power supply unit 60 is electrically connected to the first metal yarn strand 20 and the second metal yarn strand 30. As such, the present invention can be easily coupled to a user's wearable article by for example sewing and adhesive bonding (as shown in FIGS. 7 and 8), whereby the receptacle structure 40 receives and holds the electronic unit 50 in such a way that the operation of the electronic unit 50 received and held in the receptacle structure 40 is controlled by the power supply unit 60.

Figure 1:
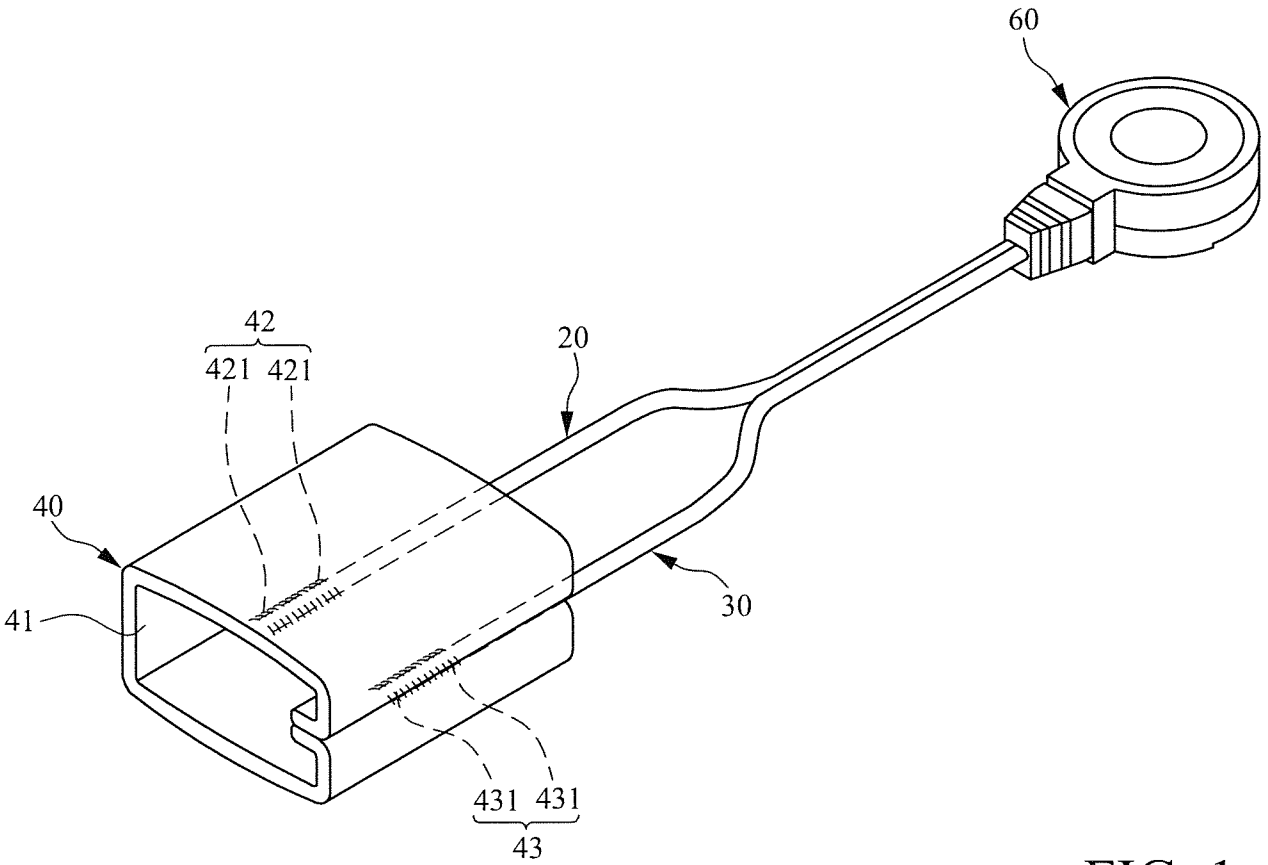
FIG. 1 is a perspective view showing an electronically-controllable woven article with receptacle structure according to the present invention.
Figure 2:
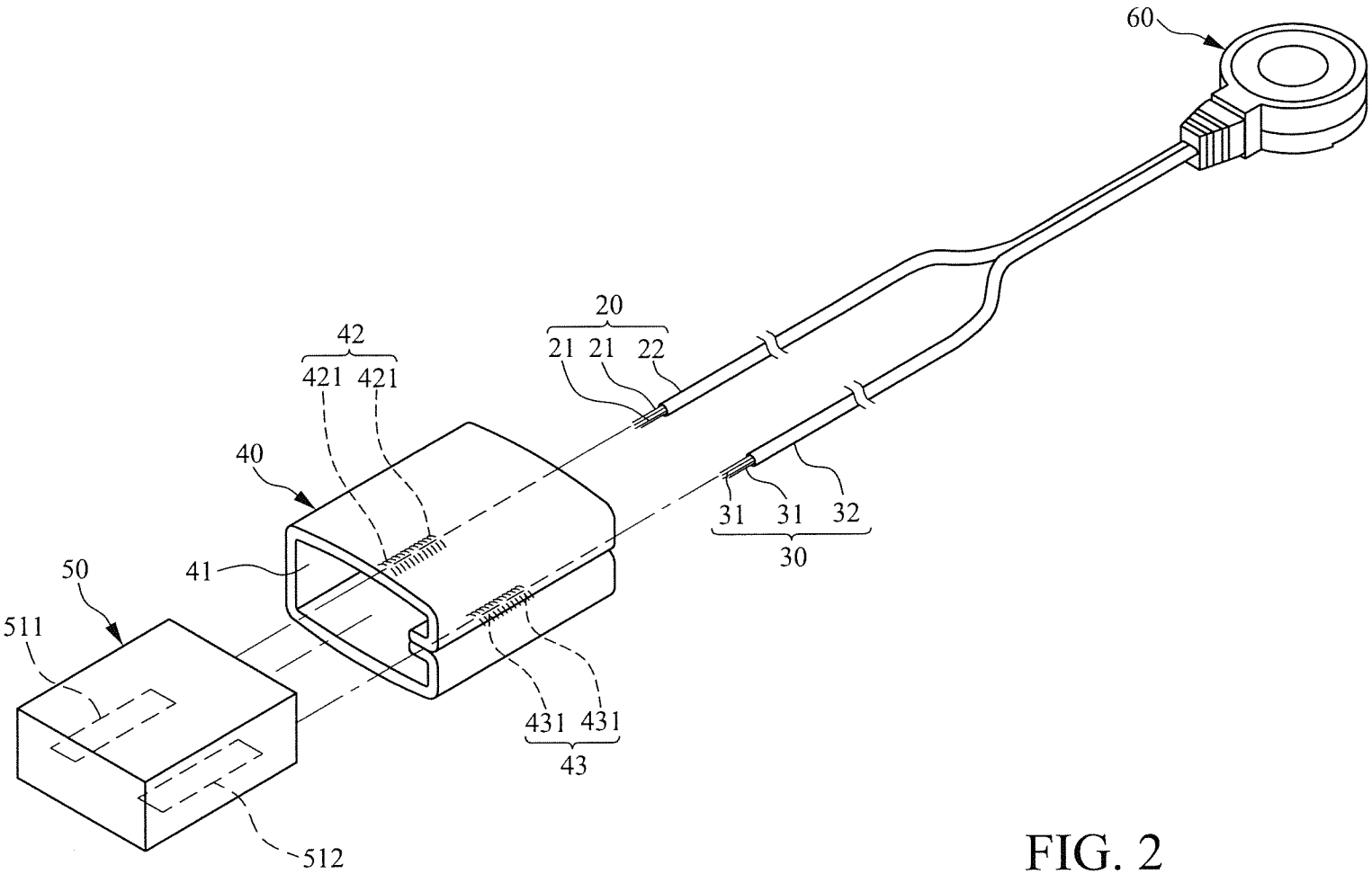
FIG. 2 is an exploded view showing an electronic unit deposited in the receptacle structure of the electronically-controllable woven article according to the present invention.

In an embodiment, as shown in FIGS. 1 and 2, the receptacle structure 40 comprises a first electrical connection section 42 and a second electrical connection section 43 mounted to side walls of the receiving space 41. The internal section of the first metal yarn strand 20 is electrically connected to the first electrical connection section 42 of the receptacle structure 40 and the internal section of the second metal yarn strand 30 is electrically connected to the second electrical connection section 43 of the receptacle structure 40. The receiving space 41 of the receptacle structure 40 corresponds to the electronic unit 50 in order to allow the electronic unit 50 to be received and retained in the receiving space 41 of the receptacle structure 40. Further, as shown in FIG. 2, the electronic unit 50 comprises two electrical connection sections 511, 512 (which are positive and negative electrodes), and the two electrical connection sections 511, 512 of the electronic unit 50 respectively correspond to the first electrical connection section 42 and the second electrical connection section 43 of the receptacle structure 40. The power supply unit 60 may comprise a single electrical cell (see FIG. 3), or alternatively and/or additionally, the power supply unit 60 is provided with a controller (or a cell container in which a plurality of cells is received), with positive and negative electrodes being located at the same side of the power supply unit 60 to facilitate electrical connection of the controller to the first metal yarn strand 20 and the second metal yarn strand 30 to supply electrical power to the electronic unit 50 and control the operation of the electronic unit 50.

Each of the first metal yarn strand 20 and the second metal yarn strand 30 is formed of a plurality of metal yarns 21, 31 to provide the two metal yarn strands with flexibility. Further, the first electrical connection section 42 and the second electrical connection section 43 of the receptacle structure 40 are both made up of a plurality of metal yarns 421, 431, whereby the plurality of metal yarns 421 of the first electrical connection section 42 of the receptacle structure 40 is allowed to interlace and entangle with and thus couple to the plurality of metal yarns 21 of the internal section of the first metal yarn strand 20 and the plurality of metal yarns 431 of the second electrical connection section 43 of the receptacle structure 40 is allowed to interlace, entangle with, and thus couple to the plurality of metal yarns 31 of the internal section of the second metal yarn strand 30 so as to form electrical connection therebetween and fix the internal section of the first metal yarn strand 20 and the internal section of the second metal yarn strand 30 to the side walls of the receiving space 41 without undesired separation. The first metal yarn strand 20 comprises a jacket layer 22 that encloses the metal yarns 21 and the second metal yarn strand 30 comprises another jacket layer 32 enclosing the metal yarns 31.

Corresponding to the number of multiple receptacle structures 40 used, the two metal yarn strands are set through the receiving spaces 41 of the multiple receptacle structures 40 and are thus divided into a plurality of electrical connection segments (see FIG. 8). The two metal yarn strands are electrically connected to the two electrical connection sections of the receptacle structure 40 associated with each segment of the two metal yarn strands, whereby multiple electronic units 50 are respectively received and held in the receiving spaces 41 of these receptacle structures 40 with the two electrical connection sections 511, 512 of each of the electronic units 50 respectively and electrically connected to the two electrical connection sections of the corresponding receptacle structure 40 thereby establishing electrical connection (such as serial connection). As such, a plurality of electronic units 50 can be operated at different sites of a wearable article to achieve a function of multi-point lighting, multi-point sounding, multi-point heating, or multi-point vibrating and massaging.

The positive and negative electrodes of the electronic unit 50 (or those of the power supply unit 60) may be arranged at the same side or different sides of the electronic unit 50 (or the power supply unit 60) according to the type thereof. Thus, the first electrical connection section 42 and the second electrical connection section 43 of the receptacle structure 40 can be set at the same side wall (see FIG. 2) or two opposite side walls of the receiving space 41 (see FIG. 3 for the receptacle structure 40 that receives and holds the power supply unit 60) in order to match the type of the electronic unit 50 (or the power supply unit 60) used.

Figure 3:
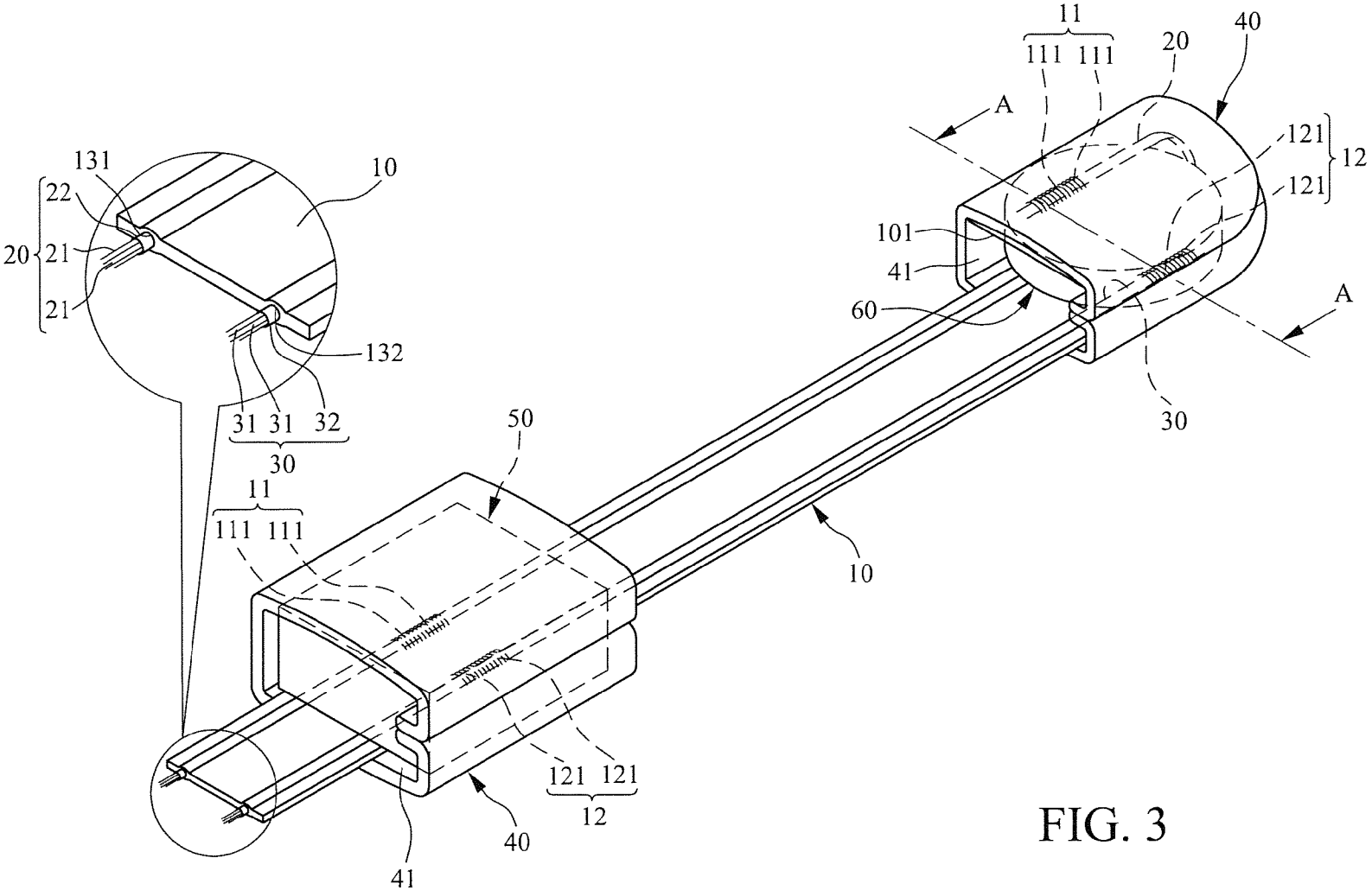
FIG. 3 is a perspective view showing the electronically-controllable woven article according to the present invention combined with a strip.
Figure 4:
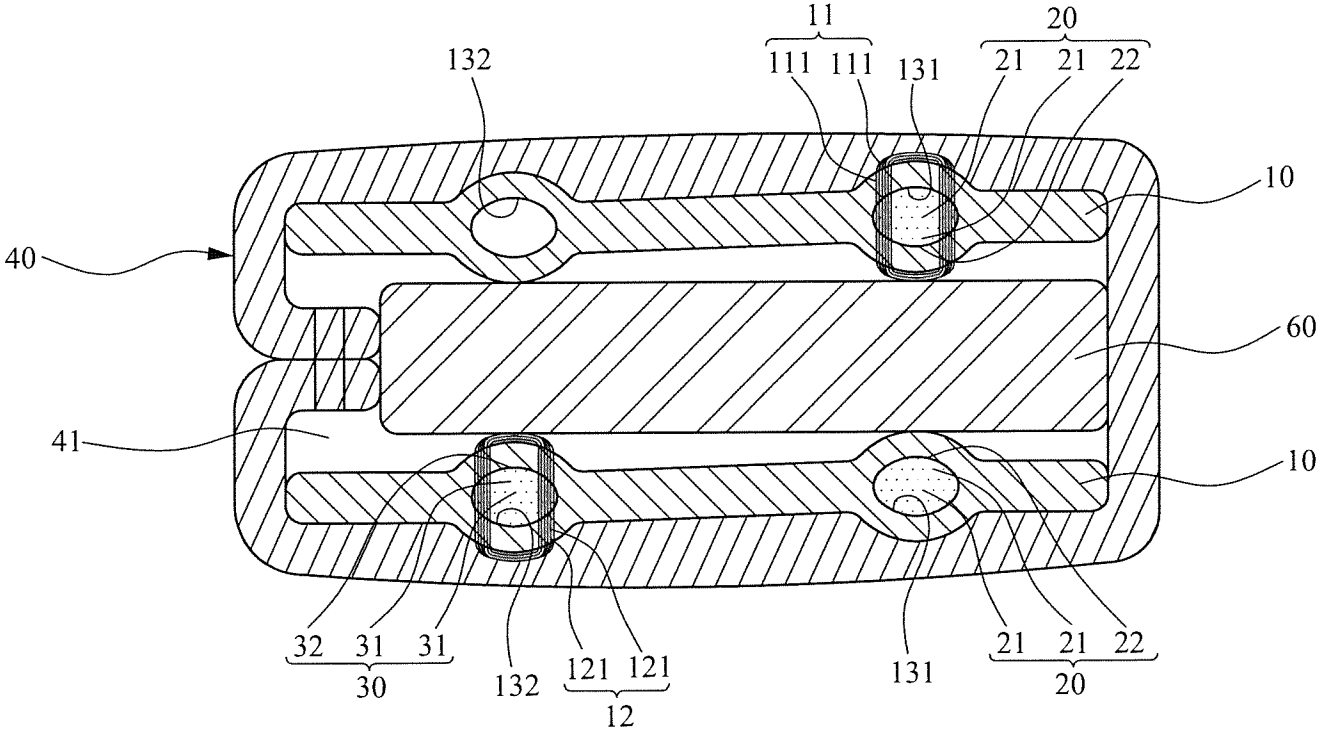
FIG. 4 is a cross-sectional view taken along line A-A of FIG. 3.

Further, as shown in FIGS. 3 and 4, the present invention further comprises a strip 10. The first metal yarn strand 20 and the second metal yarn strand 30 are arranged to couple to the strip 10 in a spaced and side-by-side manner. The strip 10 is received in the receiving space 41 and thus, the strip 10 is coupled to the receptacle structure 40. The strip 10 has a surface that has a portion corresponding to the receiving space 41 and provided with a first electrical connection section 11 and a second electrical connection section 12. The first electrical connection section 11 is electrically connected to the internal section of the first metal yarn strand 20. The second electrical connection section 12 is electrically connected to the internal section of the second metal yarn strand 30. The first and second electrical connection sections 11, 12 are insulated from each other. The receiving space 41 of the receptacle structure 40 corresponds to the electronic unit 50. The electronic unit 50 has two electrical connection sections (the two electrical connection sections 511, 512 shown in FIG. 2), and the two electrical connection sections of the electronic unit 50 respectively correspond to the first electrical connection section 11 and the second electrical connection section 12 of the portion of the surface of the strips 10 that are located inside the receptacle structure 40.

The first metal yarn strand 20 and the second metal yarn strand 30 are arranged in a side-by-side manner along the strip 10 so that they show a horizontal spaced arrangement. Alternatively, a non-horizontal spaced arrangement (such as a convergent arrangement) is also feasible. Thus, the two metal yarn strands are protected from contacting each other to induce short-circuiting and allow electronic units 50 of different size to straddle thereon thereby increasing the types to which the present invention is applicable.

The strip 10 forms two receiving channels 131, 132, both extending from one end of the strip 10 to an opposite end of the strip 10 (see FIG. 6). The first metal yarn strand 20 and the second metal yarn strand 30 are respectively put through the two receiving channels 131, 132, whereby one receiving channel 131 guides the first metal yarn strand 20 to a desired position, while the other receiving channels 132 guides the second metal yarn strand 30 to a desired position.

The first electrical connection section 11 and the second electrical connection section 12 of the strip 10 are each formed of a plurality of metal yarns 111, 121. The plurality of metal yarns 111 of the first electrical connection section 11 of the strip 10 interlaces, entangles with, and thus couples to the plurality of metal yarns 21 of the internal section of the first metal yarn strand 20. The plurality of the metal yarns 121 of the second electrical connection section 12 of the strip 10 interlaces, entangles with, and thus couples to the plurality of metal yarns 31 of the internal section of the second metal yarn strand 30. As such, the first metal yarn strand 20 and the second metal yarn strand 30 that are respectively formed of a plurality of metal yarns 21, 31 are sewn and fixed in the receiving channels 131, 132 of the strip 10 to protect the first metal yarn strand 20 and the second metal yarn strand 30 from damages caused by being directly scraped or stained. Further, the two metal yarn strands can be bent following flexing of the strip 10 without being easily stretched and broken and also allow stitches to easily penetrate through the structure of the metal yarn strands to facilitate electrical connection.

Next, corresponding to the number of multiple receptacle structures 40 used, the strip 10 is set through the receiving spaces 41 of a plurality of the receptacle structures 40 and is thus divided into a plurality of electrical connection portions (see the lower end of the garment shown in FIG. 7). Similarly, a function of multi-point lighting, multi-point sounding, multi-point heating, or multi-point vibrating and massaging is achieved. Those electrical connection portions of the strip 10 respectively correspond to the segments of the two metal yarn strands. The surfaces of the electrical connection portions of the strip 10 are each provided with a first electrical connection section 11 that is electrically connected to the segment of the first metal yarn strand 20 and a second electrical connection section 12 that is electrically connected to the segment of the second metal yarn strand 30. This embodiment may also be referred to what shown in FIG. 3. Namely, the strip 10 are coupled to two receptacle structures 40, and one receptacle structure 40 receives and holds the power supply unit 60, while another receptacle structure 40 receives and retains an electronic unit 50. The portions of the strip 10 that are located inside the two receiving spaces 41 are each provided with a first electrical connection section 11 and a second electrical connection section 12 to allow the power supply unit 60 to supply electrical power to the electronic unit 50.

In the right-hand side of FIG. 3, a simple embodiment of the power supply unit 60 is shown, which can be embodied with a single electrical cell (such as a button cell). However, since the positive and negative electrodes are located at different sides, to establish electrical connection, the first electrical connection section 11 and the second electrical connection section 12 of the portion of the strip 10 that is received in the receiving space 41 are arranged alternately and the portion of the strip 10 at that site is inserted, in a bent form, into and coupled to (such as sewing and adhesive bonding) the opposite side walls of the receiving space 41, as shown in FIG. 4, whereby the first electrical connection section 11 is located on one side wall of the receiving space 41, while the second electrical connection section 12 is located on an opposite side wall of the receiving space 41, so that the portion of the strip 10 at the site can enclose the positive and negative electrodes that are located at opposite sides of the power supply unit 60 to have the first electrical connection section 11 and the second electrical connection section 12 respectively and electrically connected to the positive and negative electrodes of the power supply unit 60. Further, in the left-hand side of FIG. 3, the first electrical connection section 11 and the second electrical connection section 12 of the portion of the strip 10 that is located inside another one of the receptacle structures 40 are arranged in a side-by-side fashion and are located on the same side wall of the receiving space 41 of said another receptacle structure 40. Again, this is convenient for being directly and electrically connected to positive and negative electrodes of the electronic unit 50 that are located at the same side of electronic unit.

In the above structure, the two metal yarn strands are both provided with jacket layers 22, 32 for protecting and confining the metal yarns 21, 31. The jacket layers 22, 32 are of a thin insulation structure with elasticity to allow of easy flexing and bending and also allow the plurality of metal yarns 111, 121, 421, 431 of the first electrical connection sections 11, 42 and the second electrical connection sections 12, 43 to respectively extend through the jacket layers 22, 32 of the two metal yarn strands for electrically connecting to the plurality of metal yarns 21, 31 of the two metal yarn strands.

As shown in FIGS. 5 and 6, the present invention further comprises a connector 61 arranged at one end of the power supply unit 60. The connector 61 is connected to wires of positive and negative electrodes of the power supply unit 60. An end of the first metal yarn strand 20 and an end of the second metal yarn strand 30 are coupled to and electrically connected to a counterpart connector 70. The counterpart connector 70 is connectable, in an efficient manner, to the connector 61 to establish electrical connection, allowing easy connection and disconnection for substitute and replacement.

Further, the receptacle structure 40 can be embodied as a knitted band, an elastic knitted band, a bag, an elastic bag, a box, a light-transmitting knitted band, a light-transmitted bag, or light-transmitting box. For example, the receptacle structure 40 can be made by sewing elastic knitted band(s) and elastic bag(s) in order to accommodate and position electronic units 50 (or power supply units 60) of different sizes. The electronic unit 50 can be embodied as a light-emitting article (such as a light-emitting diode based lighting device), in order to provide a function of lighting alarm on the woven article worn on a user. Further, the electronic unit 50 can alternatively be embodied as a heating article (such as electrical heating pad and electrical heating wire, not shown in the drawings), in order to provide the woven article worn on a user with a function of heating and warm keeping. Or alternatively, the electronic unit 50 can be embodied as a sound-emitting article (such as a portable multimedia playing device or a buzzer shown in the left-hand side of FIG. 7), in order to provide a function of sounding and reminding. Further, the electronic unit 50 that is shown in FIG. 7 at a central portion of the garment can be embodied as a vibrating and massaging article (such as a small-sized eccentric motor), whereby each vibrating and massaging article (namely the electronic unit designated with reference numeral 50) is connected through two metal yarn strands (namely reference numerals 20, 30) to a pushbutton controller (namely the power supply unit designated with reference numeral 60), in order to provide a function of vibration and massaging. Further, the electronic unit 50 used in the present invention can also be all sorts of electronic devices (such as various portable electronic devices, including multimedia audio/video device, electronic dictionary, recording pen, and pinhole camera), in order to allow a user to easily deposit the electronic unit 50 in the receptacle structure 40 and to supply electrical power to the electronic unit 50 from the power supply unit 60.

Referring to FIG. 8, the present invention further comprises a hollow band 80. The first metal yarn strand 20, the second metal yarn strand 30, and a plurality of receptacle structures 40 are received and retained in the hollow band 80 for protection and aesthetics purposes. The power supply unit 60 is set outside the hollow band 80 for easy replacement and substitute. The hollow band 80 can be made by knitting or weaving light-reflective yarns to show an effect of surface light reflection. This, when combined with the lighting alarm provided by the electronic unit, help improving security and safety.

Figure 9:
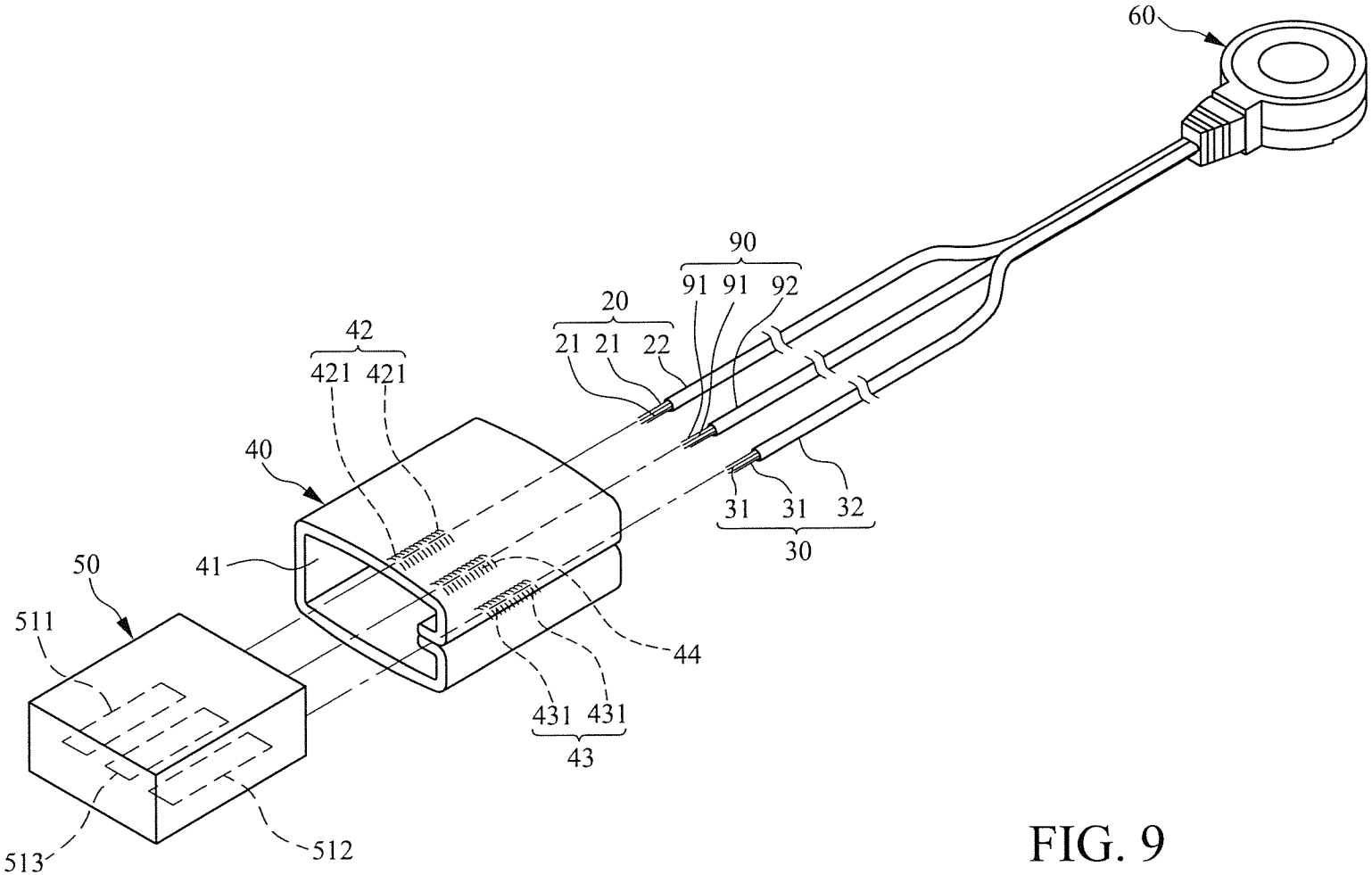
FIG. 9 is a perspective view showing the electronically-controllable woven article of FIG. 2 further comprising a third metal yarn strand.

The present invention is further illustrated in FIG. 9 by further comprising a third metal yarn strand 90. The third metal yarn strand 90 is arranged in a side-by-side fashion at one side of the first metal yarn strand 20 and the second metal yarn strand 30. The third metal yarn strand 90 extends into the receiving space 41. The third metal yarn strand 90 has an internal section that corresponds to the receiving space 41 and is coupled to the receptacle structure 40. The receptacle structure 40 comprises a third electrical connection section 44 mounted to a side wall of the receiving space 41. The internal section of the third metal yarn strand 90 is electrically connected the third electrical connection section 44 of the receptacle structure 40. The electronic unit 50 comprises three electrical connection sections 511, 512, 513, and the three electrical connection sections 511, 512, 513 of the electronic unit 50 respectively correspond to the first electrical connection section 42, the second electrical connection section 43, and the third electrical connection section 44 of the receptacle structure 40. In the embodiment shown in FIG. 9, the third metal yarn strand 90 is electrically connected to the power supply unit 60 to serve as a signal line. The power supply unit 60 is a pushbutton controller, which contains therein an electrical cell, whereby when power is turned on, the electrical power is supplied through the first metal yarn strand 20 and the second metal yarn strand 30 to the electronic unit 50, which in this case serves as a light-emitting device, to give off light. When the user pushes the pushbutton of the controller again, a control signal is transmitted through the third metal yarn strand 90 to the light-emitting device to give off light in a twinkling and flicking manner.

Figure 10:
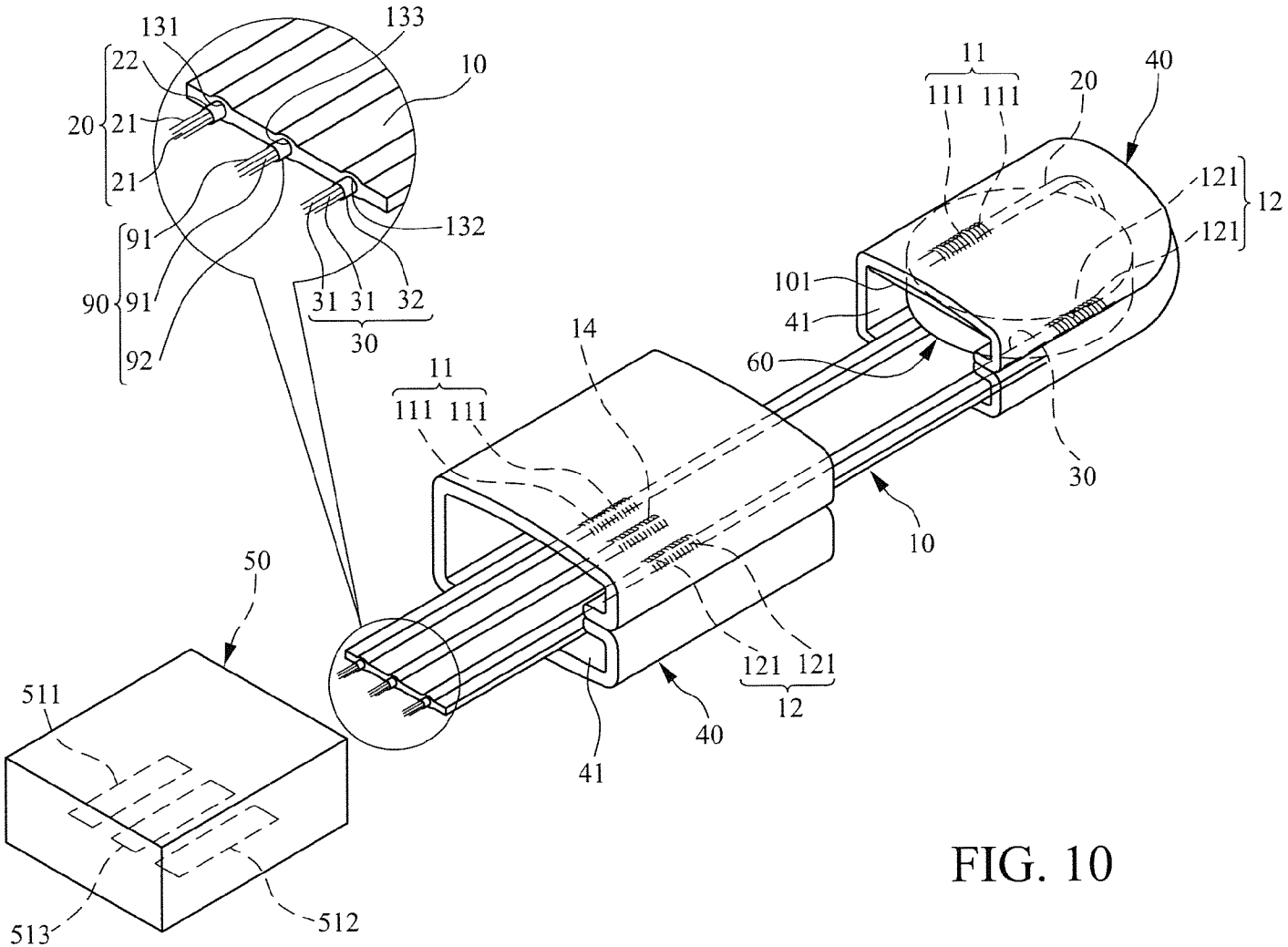
FIG. 10 is a perspective view showing the electronically-controllable woven article of FIG. 3 further comprising a third metal yarn strand.

Further, as shown in FIG. 10, the present invention alternatively arranges the third metal yarn strand 90, the first metal yarn strand 20, and the second metal yarn strand 30 in a side-by-side but spaced manner in the strip 10. The strip 10 comprises an additional receiving channel 133 (which is not a necessary structure). The third metal yarn strand 90 can be optionally received and retained in the receiving channels 133. The portion of the surface of the strip 10 that corresponds to the receiving space 41 further comprises a third electrical connection section 14 that is electrically connected to the third metal yarn strand 90. The first, second, and third electrical connection sections 11, 12, 14 are insulated from each other on the strip 10. The electronic unit 50 comprises three electrical connection sections 511, 512, 513. The three electrical connection sections of the electronic unit 50 respectively correspond to the first, second, and third electrical connection sections 11, 12, 14 on the surface of the strip 10. In the embodiment of FIG. 10, the power supply unit 60 is a single electrical cell that supplies electrical power through only two metal yarn strands (namely reference numerals 20, 30). The third metal yarn strand 90 is not necessarily electrically connected to the power supply unit 60 (in case of only one single cell used) and the third metal yarn strand 90 may serve as a grounding line for statistic interference protection, but not limited thereto. The third metal yarn strand 90 may also serve as a signal line to electrically connect to another controller (such as electronic device including a mobile phone and a computer).

The third electrical connection section 14, 44 is similarly formed of a plurality of metal yarns that interlace, entangles with, and couple to a plurality of metal yarns 91 of a section of the third metal yarn strand 90 to establish electrical connection.

As such, the present invention provides an electronically-controllable woven article with receptacle structure, which comprises a first metal yarn strand 20, a second metal yarn strand 30, at least one the receptacle structure 40, and a power supply unit 60 to allow the receptacle structure 40 to receive a power supply unit 60, such as an electrical cell or a controller and to couple to a woven article for use and show flexibility for easy coupling to various woven or knitted articles, such as a hat (see FIG. 8), a garment (see FIG. 7), pants, pouch, and bag, and also comprise the functions of lighting alarm, heating and warm keeping, sounding and reminding, or vibrating and massaging thereby improving the utility, convenience and safety of use.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An electronically-controllable woven article with receptacle structure for electrically connecting at least one electronic unit, the electronically-controllable woven article comprising:

a first metal yarn strand;

a second metal yarn strand, which is arranged at one side of the first metal yarn strand in a side-by-side manner;

at least one receptacle structure, which forms a receiving space corresponding to the electronic unit, the first metal yarn strand and the second metal yarn strand extending into the receiving space, the first metal yarn strand and the second metal yarn strand individually having a section, both sections coupled to the receptacle structure; and a power supply unit, which is electrically connected to the first metal yarn strand and the second metal yarn strand;

wherein the receptacle structure comprises a first electrical connection section and a second electrical connection section on side walls of the receiving space, the section of the first metal yarn strand being electrically connected to the first electrical connection section of the receptacle structure, the section of the second metal yarn strand being electrically connected to the second electrical connection section of the receptacle structure, the receiving space of the receptacle structure corresponding to the electronic unit, the electronic unit comprising two electrical connection sections, the two electrical connection sections of the electronic unit respectively corresponding to the first electrical connection section and the second electrical connection section of the receptacle structure;

wherein the first metal yarn strand and the second metal yarn strand each comprise a plurality of metal yarns and the first electrical connection section and the second electrical connection section of the receptacle structure each comprise a plurality of metal yarns, the plurality of metal yarns of the first electrical connection section of the receptacle structure interlacing, entangling with, and coupled to the plurality of metal yarns of the first metal yarn strand, the plurality of metal yarns of the second electrical connection section of the receptacle structure interlacing, entangling with, and coupled to the plurality of metal yarns of the second metal yarn strand, the first metal yarn strand comprising a jacket layer enclosing the metal yarns, the second metal yarn strand comprising another jacket layer enclosing the metal yarns.

2. The electronically-controllable woven article with receptacle structure as claimed in claim 1, wherein the first electrical connection section and the second electrical connection section of the receptacle structure are either located on the same side wall or on opposite side walls of the receiving space.

3. The electronically-controllable woven article with receptacle structure as claimed in claim 1 further comprising a strip, the first metal yarn strand and the second metal yarn strand being arranged in a side-by-side but spaced manner in the strip, the strip being received in the receiving space, the strip being coupled to the receptacle structure, the strip having a surface that has a portion corresponding to the receiving space and provided with a first electrical connection section electrically connected to the first metal yarn strand and a second electrical connection section electrically connected to the second metal yarn strand, the first and second electrical connection sections being insulated from each other, the receiving space of the receptacle structure corresponding to the electronic unit, the electronic unit comprising two electrical connection sections, the two electrical connection sections of the electronic unit respectively corresponding to the first electrical connection section and the second electrical connection section on the surface of the strip in the receptacle structure.

4. The electronically-controllable woven article with receptacle structure as claimed in claim 3, wherein the strip forms two receiving channels both extending from one end of the strip to another end of the strip, the first metal yarn strand and the second metal yarn strand being respectively received in the two receiving channels.

5. The electronically-controllable woven article with receptacle structure as claimed in claim 3, wherein the first metal yarn strand and the second metal yarn strand each comprise a plurality of metal yarns and the first electrical connection section and the second electrical connection section of the strip each comprise a plurality of the metal yarns, the plurality of metal yarns of the first electrical connection section of the strip interlacing, entangling with, and coupled to the plurality of metal yarns of the first metal yarn strand, the plurality of metal yarns of the second electrical connection section of the strip interlacing, entangling with, and coupled to the plurality of metal yarns of the second metal yarn strand, the first metal yarn strand comprising a jacket layer, the jacket layer enclosing the metal yarns of the first metal yarn strand, the second metal yarn strand comprising another jacket layer, said another jacket layer enclosing the metal yarns of the second metal yarn strand.

6. The electronically-controllable woven article with receptacle structure as claimed in claim 3, wherein the first electrical connection section and the second electrical connection section of the strip are either located on the same side wall or on opposite side walls of the receiving space.

7. The electronically-controllable woven article with receptacle structure as claimed in claim 3, further comprising a third metal yarn strand, the first, second, and third metal yarn strands being arranged in a side-by-side but spaced manner in the strip, the portion of the surface of the strip that corresponds to the receiving space being provided with a third electrical connection section electrically connected to the third metal yarn strand, the first, second, and third electrical connection sections on the surface of the strip being insulated from each other, the electronic unit comprising three electrical connection sections, the three electrical connection sections of the electronic unit respectively corresponding to the first, second, and third electrical connection sections of the strip.

8. The electronically-controllable woven article with receptacle structure as claimed in claim 7, wherein the third metal yarn strand comprises one of a signal line and a grounding line.

9. The electronically-controllable woven article with receptacle structure as claimed in claim 7, wherein the electronic unit comprises one of a light-emitting article, a heating article, a vibrating and massaging article, and a sound-emitting article.

10. The electronically-controllable woven article with receptacle structure as claimed in claim 7, wherein the electronic unit comprises a portable electronic device.

11. The electronically-controllable woven article with receptacle structure as claimed in claim 3, wherein the electronic unit comprises one of a light-emitting article, a heating article, a vibrating and massaging article, and a sound-emitting article.

12. The electronically-controllable woven article with receptacle structure as claimed in claim 3, wherein the electronic unit comprises a portable electronic device.

13. The electronically-controllable woven article with receptacle structure as claimed in claim 1, wherein the power supply unit comprises a connector, an end of the first metal yarn strand and the second metal yarn strand being electrically connected to a counterpart connector, the connector being detachably connectable to the counterpart connector.

14. The electronically-controllable woven article with receptacle structure as claimed in claim 1, wherein the receptacle structure comprises one of a knitted band, a pouch, and a box.

15. The electronically-controllable woven article with receptacle structure as claimed in claim 1, wherein the power supply unit comprises a controller, the controller being electrically connected to the first metal yarn strand and the second metal yarn strand.

16. The electronically-controllable woven article with receptacle structure as claimed in claim 1 further comprising a hollow band, the first metal yarn strand, the second metal yarn strand, and the receptacle structure being received in the hollow band, the power supply unit being located outside the hollow band.

17. The electronically-controllable woven article with receptacle structure as claimed in claim 1 further comprising a third metal yarn strand, the third metal yarn strand being arranged in a side-by-side manner at one side of the first metal yarn strand and the second metal yarn strand, the third metal yarn strand extending into the receiving space, the third metal yarn strand having a section and coupled to the receptacle structure, the receptacle structure comprising a third electrical connection section mounted to a side wall of the receiving space, the section of the third metal yarn strand being electrically connected to the third electrical connection section of the receptacle structure, the electronic unit comprising electrical connection sections, the three electrical connection sections of the electronic unit respectively corresponding to the first electrical connection section, the second electrical connection section, and the third electrical connection section of the receptacle structure.

18. The electronically-controllable woven article with receptacle structure as claimed in claim 17, wherein the third metal yarn strand comprises one of a signal line and a grounding line.

19. The electronically-controllable woven article with receptacle structure as claimed in claim 17, wherein the electronic unit comprises one of a light-emitting article, a heating article, a vibrating and massaging article, and a sound-emitting article.

20. The electronically-controllable woven article with receptacle structure as claimed in claim 17, wherein the electronic unit comprises a portable electronic device.

21. The electronically-controllable woven article with receptacle structure as claimed in claim 1, wherein the electronic unit comprises one of a light-emitting article, a heating article, a vibrating and massaging article, and a sound-emitting article.

22. The electronically-controllable woven article with receptacle structure as claimed in claim 1, wherein the electronic unit comprises a portable electronic device.

* * * * *